US012696984B1

(12) United States Patent
Barry

(10) Patent No.: US 12,696,984 B1
(45) Date of Patent: Aug. 4, 2026

(54) BED EXTENSION PLATFORM SYSTEM

(71) Applicant: Sloane Kristen Barry, Dallas, TX (US)

(72) Inventor: Sloane Kristen Barry, Dallas, TX (US)

( * ) Notice: Subject to any disclaimer, the term of this patent is extended or adjusted under 35 U.S.C. 154(b) by 36 days.

(21) Appl. No.: 18/656,967

(22) Filed: May 7, 2024

(51) Int. Cl.
*A47C 19/04* (2006.01)
*A47C 19/02* (2006.01)
*A47C 23/00* (2006.01)

(52) U.S. Cl.
CPC ..... *A47C 19/04* (2013.01); *A47C 19/027* (2013.01); *A47C 23/005* (2013.01)

(58) Field of Classification Search
CPC ..... A47C 19/04; A47C 19/027; A47C 23/005; A47C 19/024; A47C 19/12; A47C 19/045; A47C 19/025; A47C 31/123; A47C 19/126; A47C 19/028; A47C 19/022; A47C 19/021; A47C 23/061
USPC ..... 5/202, 200.1, 181, 185, 236.1
See application file for complete search history.

(56) References Cited

U.S. PATENT DOCUMENTS 5,996,145 A * 12/1999 Taylor ..... A47C 19/045 5/310
6,357,065 B1 * 3/2002 Adams ..... A61G 7/005 5/617
8,572,777 B1 * 11/2013 Schulte ..... A47C 19/04 5/183
9,009,888 B1 * 4/2015 Tekulve ..... A61G 7/015 5/202
11,484,449 B2 * 11/2022 Tumavich ..... A61G 7/015

OTHER PUBLICATIONS

"YouTube—Yak About It® The College Converter—Twin XL to Full XL Bed Frame" YouTube, Date: 07.23.2021, www.youtube.com/watch?v=qlkAQRc3W-M (Year: 2021).*
"YouTube—Yak About It® The College Converter—Twin XL to Full XL Bed Frame" YouTube, Date: 07.22.2021, www.youtube.com/watch?v=s6ibEmnmEVk (Year: 2021).*
"Somnia+." Bed Expander Kit, www.merriam-webster.com/dictionary/pipe. (Year: 2024).*
Yak About It® The College Converter—Twin XL to Full XL Bed Frame, hereinafter Yak About It® The College Converter Jul. 2022 (NPL : Date Jul. 22, 2021—https://www.youtube.com/watch?v=s6ibEmnmEVk) (Year: 2021).*

(Continued)

*Primary Examiner* — Madison Matthews
(74) *Attorney, Agent, or Firm* — Law Office of Sam Sokhansanj PLLC

(57) ABSTRACT

A bed extension platform system is that allows users to extend the width of beds, including the width of the mattress or sleeping surface area, wherein the bed extension platform is lightweight, durable, comfortable, simple to assemble and disassemble, secure, and cost effective to manufacture, among other advantages. In one non-limiting exemplary embodiment, the bed extension platform system can include a plurality of planks made of a non-wood material, a cross-bar member secured to each opposing side of at least two planks, and at least two first flexible straps secured to each of the plurality of planks from below. Further, the bed extension platform system can further include a plurality of second straps, wherein each of the plurality of second straps are adapted to secure each cross-bar to a bed frame.

8 Claims, 8 Drawing Sheets

(56) References Cited

OTHER PUBLICATIONS

Yak About It® The College Converter—Twin XL to Full XL Bed Frame, hereinafter 'Yak About It® The College Converter Jul. 2023' (NPL : Date Jul. 23, 2021—https://www.youtube.com/watch?v=s6ibEmnmEVk) (Year: 2021).*

"Yak About It® The College Converter Twin XL to Full XL Bed Frame," retrieved on May 7, 2024 from: https://www.dormco.com/Twin XL to Full XL Dorm Bed Converter Kit College_p/tcc-txl-fxl-bed.htm; 3pp.; publication date unknown.

* cited by examiner

BED EXTENSION PLATFORM SYSTEM

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Many bed platforms are not sufficiently sized in width to accommodate larger people, or for people who generally prefer larger size beds. Such small beds and their associated platforms and mattresses are particularly common for college dormitories, where the beds are typically sized as "Twin," "Twin XL," or "Twin Extra" size beds and mattresses, or commonly 38"×80" or 38"×75". Similarly, many hotel rooms, hostels, or small quarters typically also have small width or twin-size related sizes which can be undesirable for users and guests. Accordingly, it is desirable to extend the width size of existing Twin/Twin XL style beds and platforms, including increasing the size of the mattress for such beds.

Hence, what is needed is a bed extending system that allows users to extend the size and widths of beds, including the width of the mattress or sleeping surface area, that is lightweight, durable, comfortable, simple to set up, secure, and cost effective to manufacture.

BRIEF SUMMARY

In one aspect of the disclosure described herein, a bed frame extension platform system is disclosed that allows users to extend the size and width of beds, including the width of the mattress or sleeping surface area, wherein the bed extension platform system is lightweight, durable, comfortable, simple to assemble and disassemble, secure, and cost effective to manufacture, among other advantages. In one non-limiting exemplary embodiment, the bed extension platform system can include a plurality of planks made of a non-wood material, a cross-bar member secured to each opposing side of at least two planks, and at least two first flexible straps secured to each of the plurality of planks from below. Further, the bed extension platform system can further include a plurality of second straps, wherein each of the plurality of second straps are adapted to secure each cross-bar to a bed frame. In addition, the bed extension platform system can include a first cushion member and a second cushion member. Here, each of the first cushion member and the second cushion member can include a plurality of layers stacked on top of each other. Further, each of the plurality of layers are of varying thickness. Further, the bed extension platform system can include a bracket, wherein the bracket is secured to one end of at least one of the plurality of planks via one or more fasteners.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
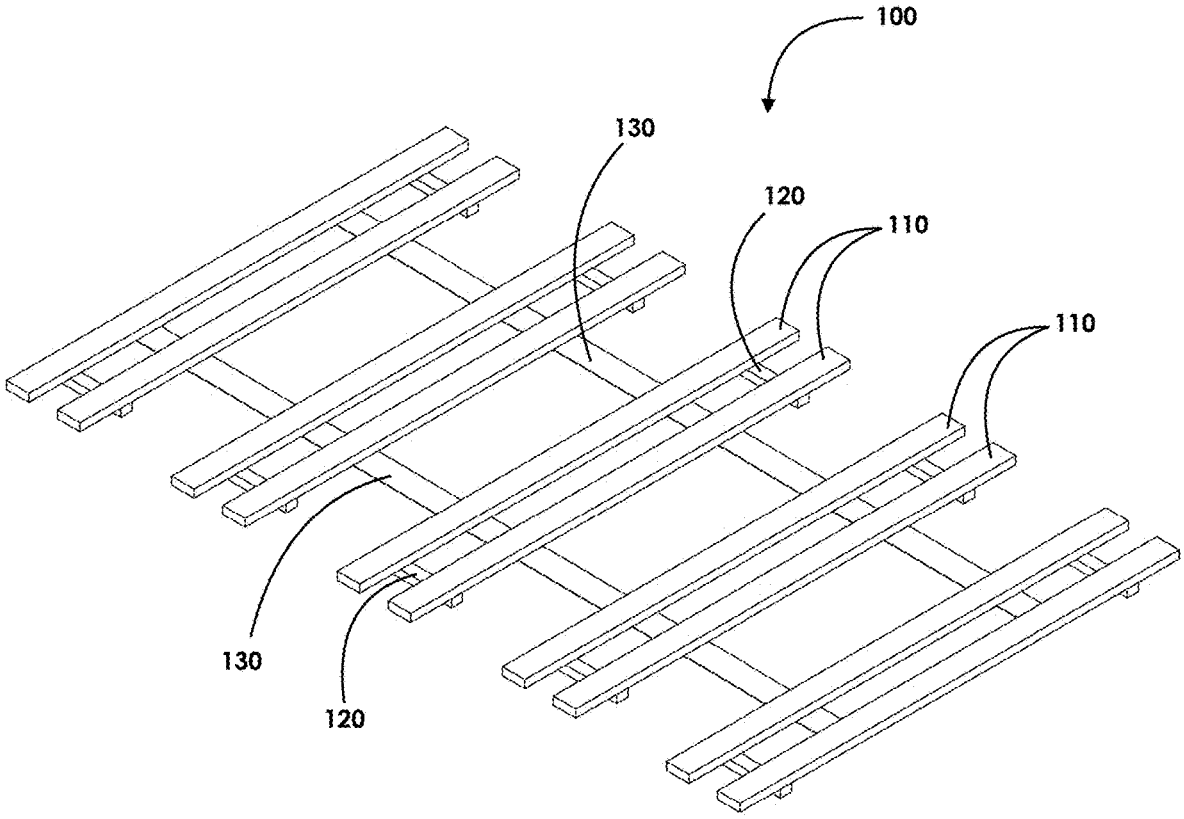
FIG. 1 illustrates a perspective view for a bed extension platform of the disclosure described herein, according to one or more non-limiting exemplary embodiments.
Figure 2A:
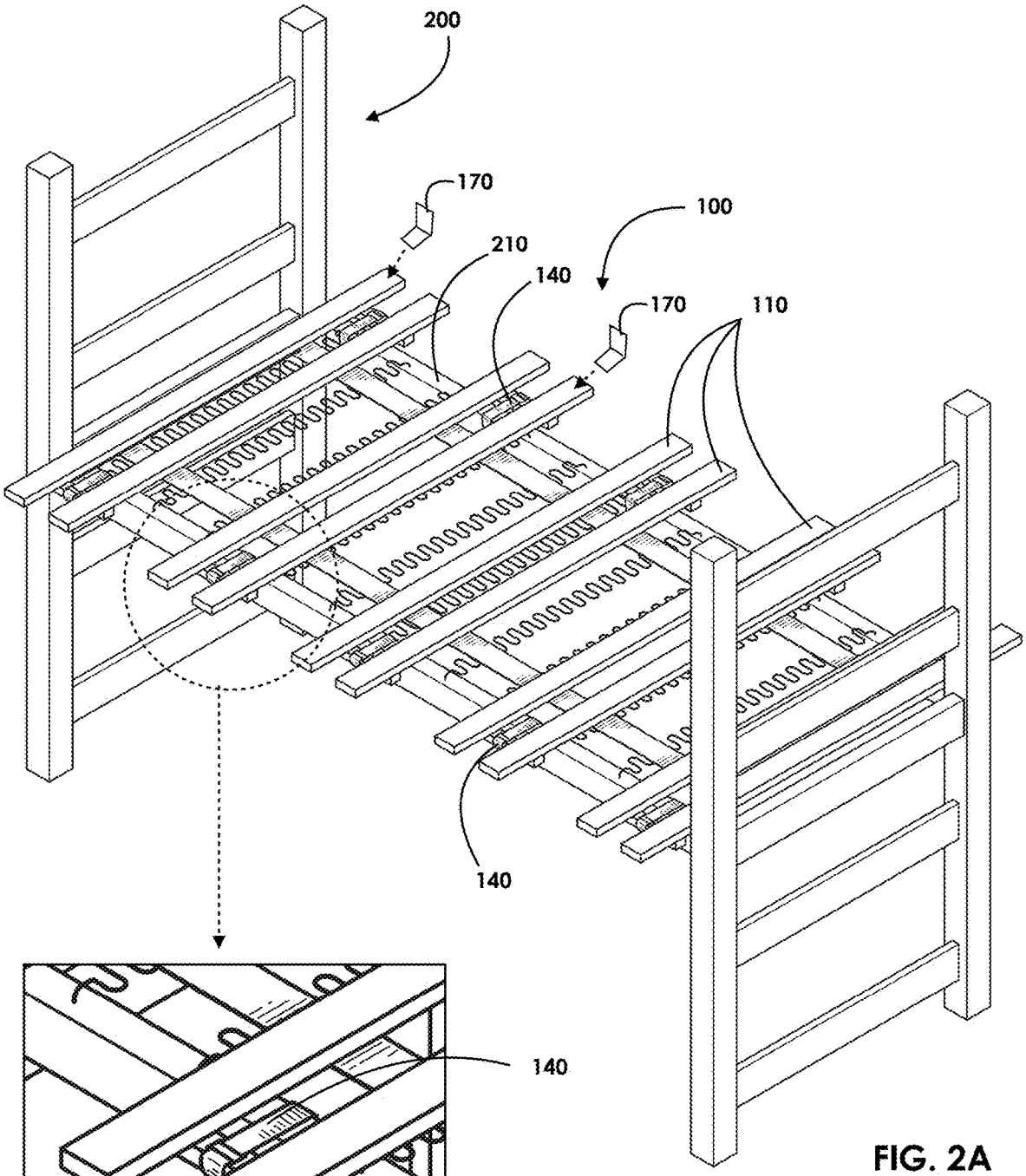
FIG. 2A illustrates a perspective view of the bed extension platform of FIG. 1 secured to a bed frame, according to one or more non-limiting exemplary embodiments.
Figure 2B:
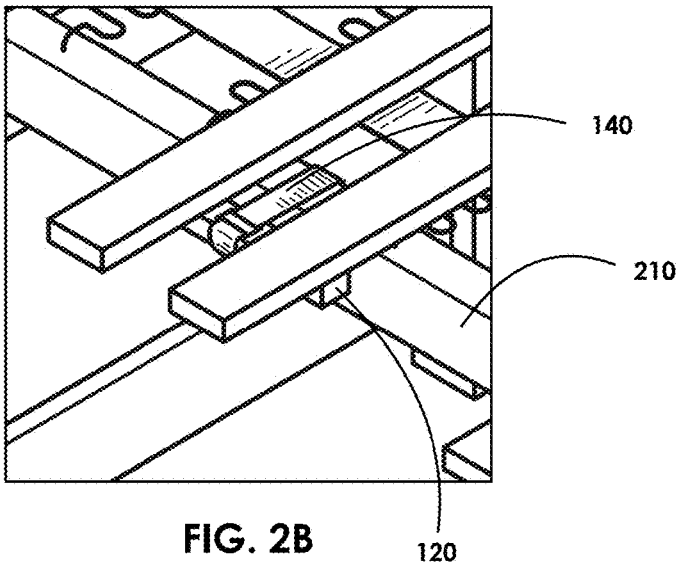
FIG. 2B illustrates a close-up perspective view of FIG. 2A.

FIG. 1 illustrates one non-limiting exemplary embodiment of a bed extension platform 100. Platform 100 can include at least 10 planks or beams 110, or five pairs of planks 110, wherein two planks are secured to each other via a cross-bar 120 on each opposing side of the pair of planks 110. Here, each cross-bar 120 is secured below the pair of planks 110 via various fasteners (screws, bolts, staples, etc.), adhesives, or the like. In addition, a pair of woven straps or flexible members 130 are further secured to each plank 110 from below, such as via various fasteners (screws, bolts, staples, etc.), adhesives, or the like. Here, straps 130 allow each pair of planks 110 to be rolled and stacked on top of each other, thereby allowing easy and simple packaging, assembly and disassembly, installation, and storage. The bed platform extension 100 may have a total length of about 80 in. and a width of about 48 in., thereby increasing the width of traditional Twin or Twin XL size beds to about 48 in or by about 10 in. Further, each plank may include a dimension of about 48 in.×3 in.×1 in and each cross-bar member may include a dimension of about 9 in.×1.5 in.×1 in. Further, each plank 110 and cross-bar member 120 may be made of any material, such as wood, plastic, polymers, polycarbonate, MDF, or the like, preferably a non-wood material made of Polystyrene (PS). Further, platform 100 may weight about 16 kgs or about 35.27 LBS. Specifically, in a preferred embodiment, each plank 110 and cross-bar member 120 of platform 100 are not entirely made of a wood material or structural tissue from the stems or roots of trees or any plant. In addition, while the current embodiment of platform 100 is shown with 10 planks, it is contemplated within the scope of the present disclosure described herein that any number of planks or pairs of planks may be used, such as from 4 planks (e.g., kids' size beds) up to 100 planks. In addition, each plank may be of any length, width, or height, and the platform may also be of any length, width, or height.

FIGS. 2A-4 illustrate one non-limiting exemplary embodiment of installing the bed extension platform 100 and system onto a bed frame 200. Here, once platform 100 is fully extended or spread out, it can be placed on top of the bed frame, bed platform, or box spring, among others, such that the platform 100 is supported from thereunder. Here, given the advantage of platform 100 be lightweight (as a result of the non-wood material the planks and cross-bars are made of), one person can pick up and place platform 100 onto a bed frame without additional assistance. Next, straps 140 can then be wrapped around each cross-bar 120 and a bed frame fixture or beam 210, thereby securing each cross-bar 120 (and platform 100) to the bed frame or bed platform, in order to prevent any unintentional side to side movement or accidental tipping of platform 100 off of the bed frame 200. Here, each strap 140 can include Velcro® or any hook and loop type fastener, D-buckles, clips, or the like, that allows for length adjustability of the strap in order to provide a tight and secure fitment around any sized support structure, such as beams 210. Optionally, as an additional safety measure, as discussed in more detail with respect to FIGS. 8A-8B, brackets 170 can be secured to one side of each plank 110 (or any number of planks) and then brackets 170 further secured to a wall or fixed support structure, in order to further prevent any movement or tipping of platform 100 off of the bed frame 200.

Figure 3:
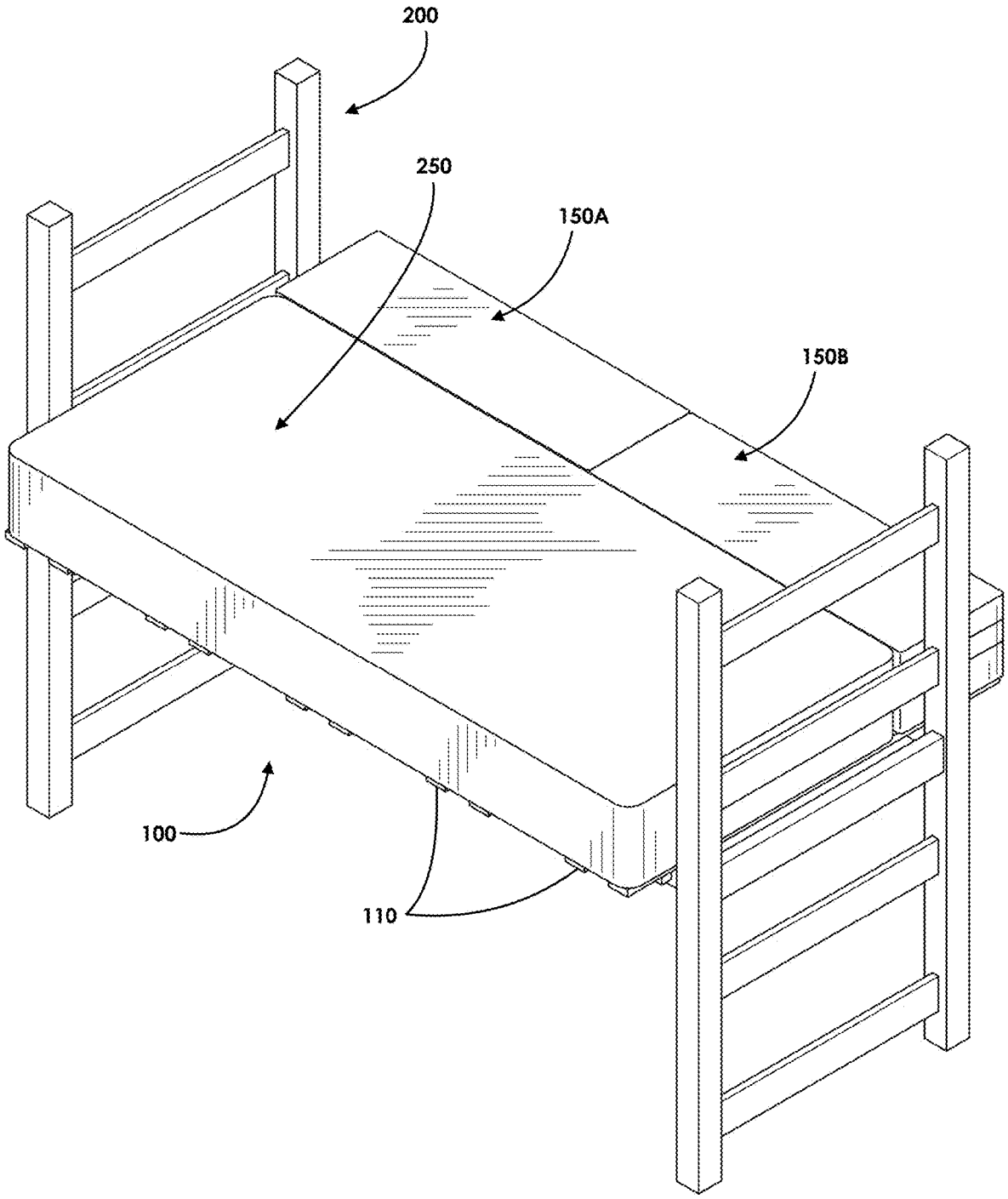
FIG. 3 illustrates a perspective view of the bed extension platform of FIG. 1 secured to a bed frame, including a mattress and mattress side extensions, according to one or more non-limiting exemplary embodiments.

FIG. 3 illustrates one non-limiting exemplary embodiment of side mattress extension members or blocks 150A and 150B, which can include multiple layers to adjust their height or thickness. Here, members 150A and 150B (and topper 160) can be packaged with the platform 100 as a system or package in one container, bag, or box. Specifically, members 150A and 150B help to accommodate and fill-in the additional space or gap created by the extended width of platform 100, wherein each of members 150A and 150B can include a width of about 10 in. to accommodate the additional width of platform 100, thereby integrating with an existing mattress 250 (such as a Twin/Twin XL mattress). Preferably, members 150A and 150B are placed between one side of mattress 250 and a wall, support structure, or fixture to prevent any movement of members 150A and 150B.

Figure 5A:
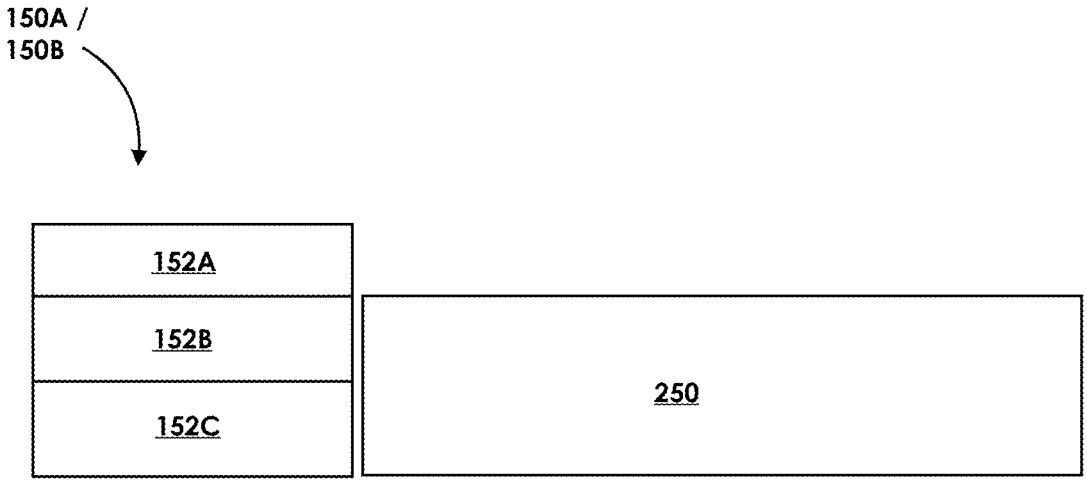
FIGS. 5A-5B illustrate simplified cross-sectional front views of the mattress side extension layers of the disclosure described herein and a mattress, according to one or more non-limiting exemplary embodiments.
Figure 5B:
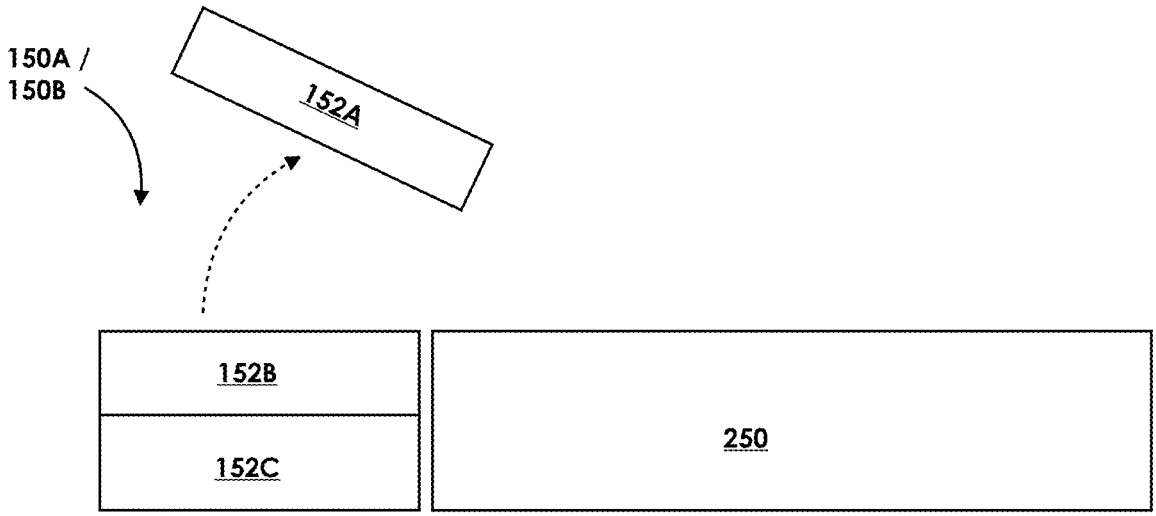

Referring to FIGS. 3 and 5A-6C, each of members 150A and 150B may include various layers stacked on top of and/or below each other, such as layers 152A-152F. The various layers of each of members 150A and 150B will be discussed in more detail with respect to FIGS. 5A-6C. As shown in the embodiment of FIGS. 5A-5B, a first (or top) layer 1520A may be removed such that the top surface of members 150A and 150B are flat, uniform, or "flush" with the top surface of mattress 250. Specifically, each layer of members 150A and 150B allow for easy and simple height/thickness customization in order to accommodate varying heights/thicknesses of mattresses. In the embodiment of FIGS. 5A-5B, layers 150A-150C allow each of members 150A and 150B to have their thickness/height adjusted from about 8 in., to 7 in., and to 6 in., among other variations.

Figure 6A:
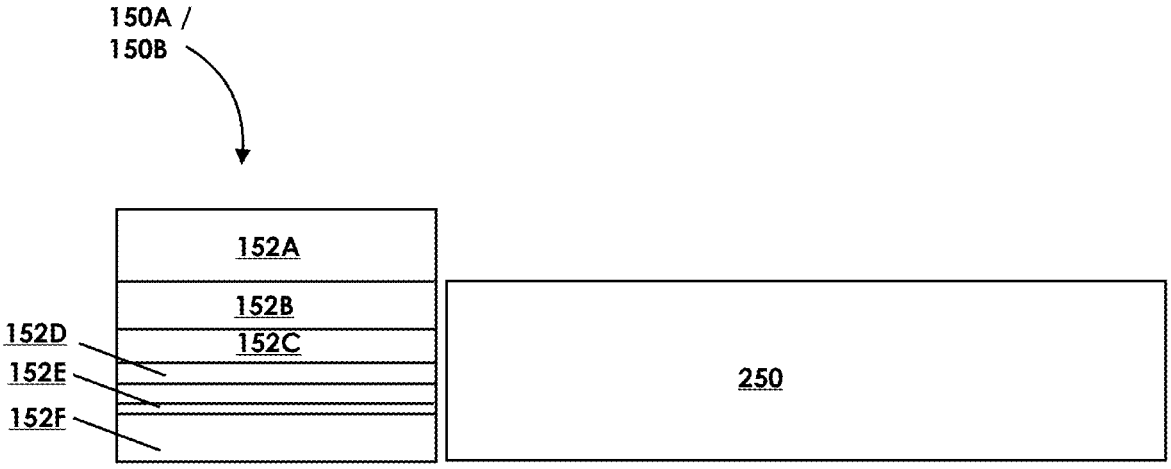
FIGS. 6A-6C illustrates simplified cross-sectional front views of the mattress side extension layers of the disclosure described herein and one or more mattresses, according to one or more non-limiting exemplary embodiments.
Figure 6B:
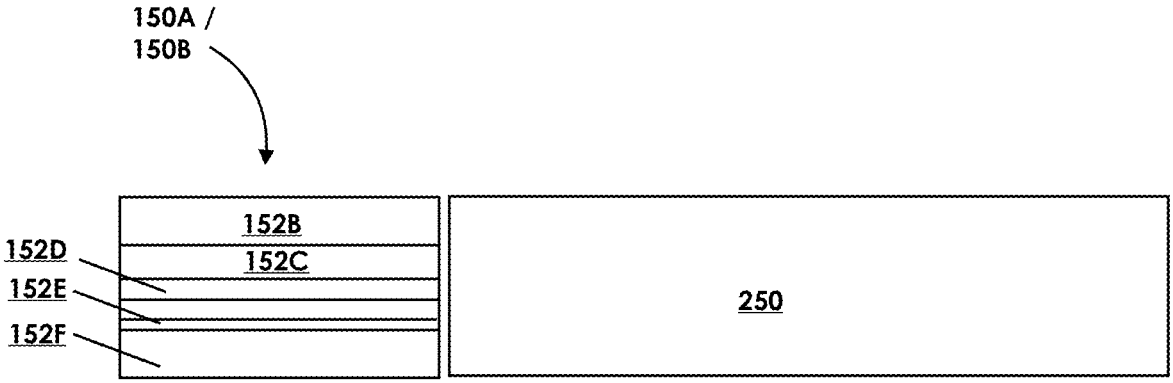
Figure 6C:
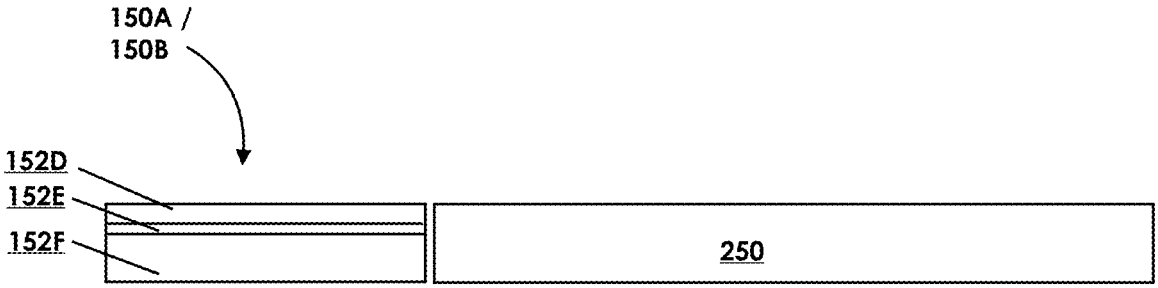

FIGS. 6A-6C illustrate another non-limiting exemplary embodiment wherein each of layers 152A-152F may be of varying thicknesses, thereby allowing a user even further customization by allowing the user to "mix and match" layers in order to match the thickness of mattress 250, such that the top surface of members 150A and 150B are even with the top surface of mattress 250.

Figure 4:
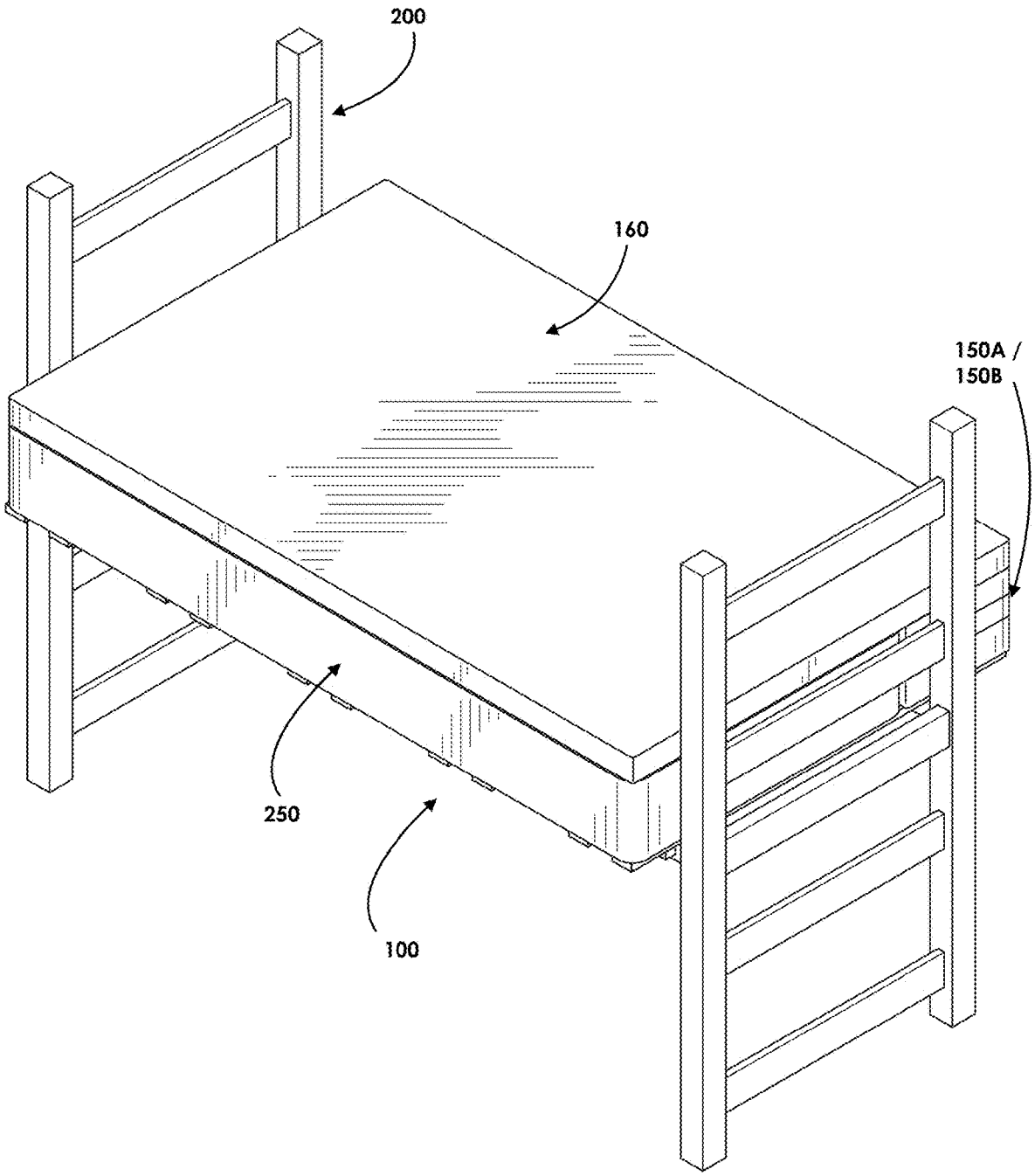
FIG. 4 illustrates a perspective view of the bed extension platform of FIG. 1 secured to a bed frame, including a mattress, mattress side extension layers, and a topper, according to one or more non-limiting exemplary embodiments.

FIG. 4 illustrates one non-limiting exemplary embodiment of a topper 160 placed on top of mattress 250 and members 150A and 150B, to provide additional comfort and a seamless sleeping surface. Here, each of topper 160 and side members 150A and 150B (including its layers) can be made of a resilient foam, cushion, or memory foam type material or any suitable material, among others. Once topper 160 is placed on top of the mattress 250 and the side extension members 150A and 150B, then assembly of platform 100 can be complete, and bed sheets (and related beddings) can then be placed thereon.

Figure 7A:
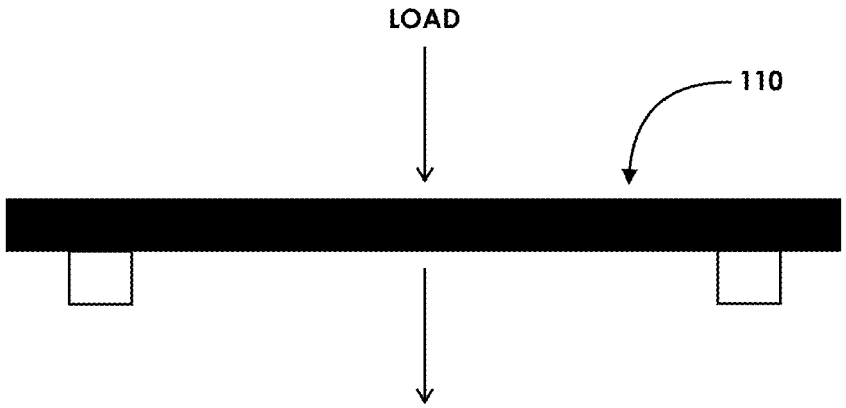
FIGS. 7A-7B illustrates simplified cross-sectional front views for a plank of the bed extension platform of the disclosure described herein, illustrating the flexibility of each plank under load, according to one or more non-limiting exemplary embodiment.
Figure 7B:
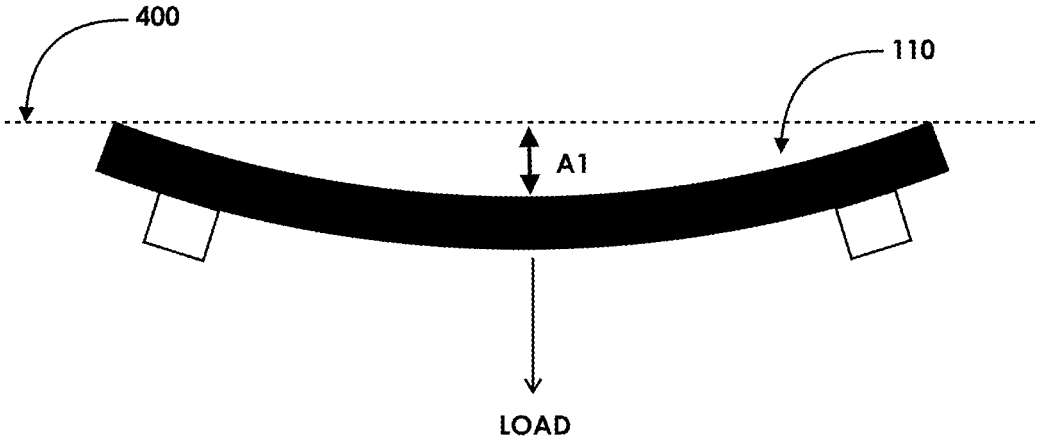

FIGS. 7A-7B illustrate a simplified cross-sectional front or side view of a plank 110 of platform 100 illustrating its flexibility. Specifically, planks 110 of platform 100 can operate as a box spring or a flexible platform for a mattress that allows for an appropriate amount of deflection of each plank 110, depending on a top load/weight placed thereon, further improving comfort to a user. For example, each plank 110 can deflect vertically to a distance A1 of about 1 in. up to 12 in., preferably up to about 6 in., relative to a horizontal top plane 400 (or from the planks original non-deflected position). Through experimental testing, planks 110 were observed to deflect up to about 6 in. from their center point relative to its non-deflected (flat) configuration, thereby accommodating the weights of various users to provide additional compliance and comfort, as opposed to conventional platforms or platform beds.

Figure 8A:
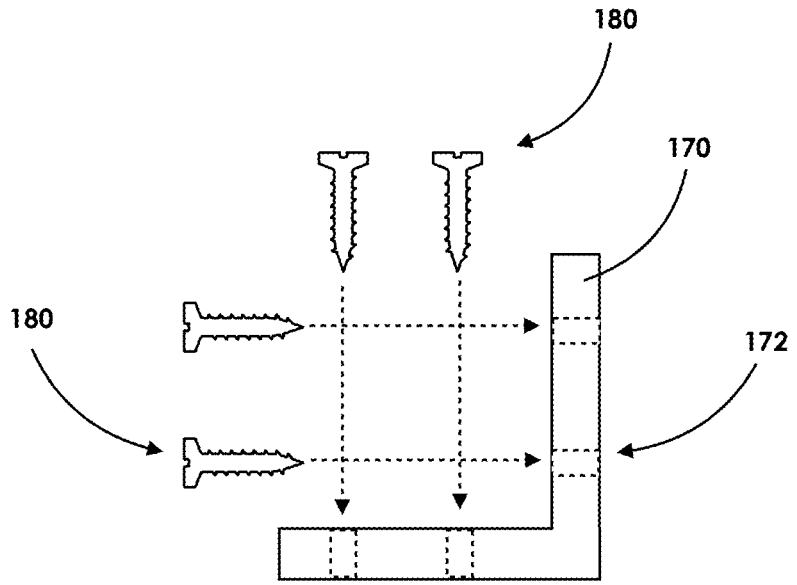
FIGS. 8A-8B illustrate a simplified cross-sectional side views of a bracket for securing the planks of the bed extension platform to a wall or fixture.
Figure 8B:
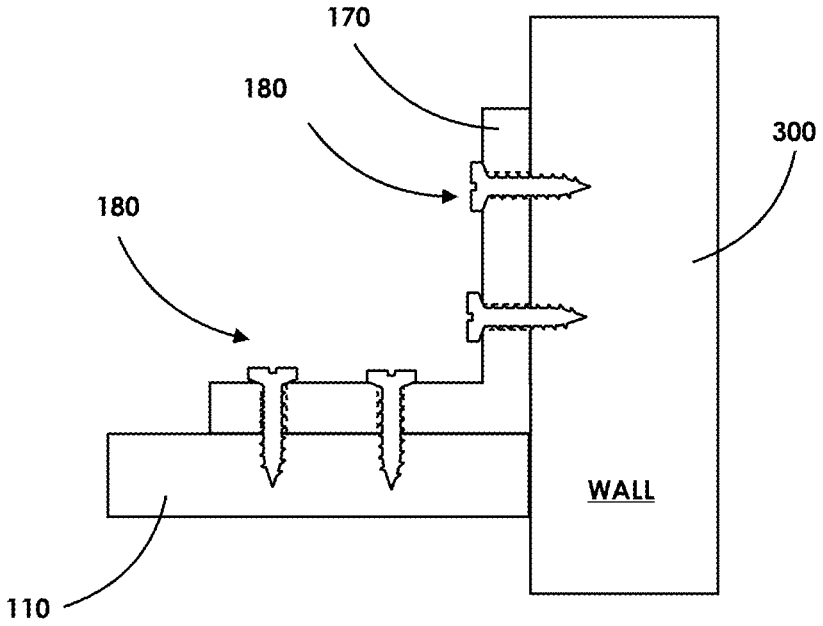

FIGS. 8A-8B illustrate simplified cross-sectional side views of a bracket 170 for securing the planks of the bed extension platform to a wall or fixture. As previously discussed, bracket 170 allows platform 100 to be further secured to a side wall, sheet rock, wood, metal, or any other type of fixed or secured structured, thereby providing an additional layer of safety and preventing movement or tipping of platform 100 off of a bed frame. In one embodiment, each bracket 170 may include a plurality of aperture or openings 172 to receive fasteners 180 therethrough, such as screws or bolts, thereby allowing the fastener to secure the bracket to one or more planks 110 and support structure 300. However, it is contemplated within the scope of the present disclosure described herein that any other type of additional securement device may be used in addition to or in lieu of brackets 170 and further allow platform 100 to be secured to any support structure 300.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A bed extension platform system, comprising:

a first set of planks comprising a first plank and a second plank;

a second set of planks comprising a third plank and a fourth plank;

a first cross-bar member secured to each opposing end region of the first plank and the second plank from the first set of planks;

a second cross-bar member secured to each opposing end region of the third plank and the fourth plank from the second set of planks; and a first strap and a second strap securing the first set of planks to the second set of planks, wherein the first strap and the second strap each extend from the first plank to the second plank, from the second plank to the third plank, and from the third plank to the fourth plank.

2. The bed extension platform system of claim 1, further comprising a plurality of third straps, wherein each of the plurality of third straps is adapted to secure the first cross-bar member and the second cross-bar member to a bed frame.

3. The bed extension platform system of claim 2, further comprising a first cushion member or a mattress.

4. The bed extension platform of claim 3, wherein the first cushion member is supported by at least the first set planks and the second set of planks from below.

5. The bed extension platform of claim 4, further comprising a plurality of second cushion members, wherein each of the plurality of second cushion members are smaller in volume relative to the first cushion member.

6. The bed extension platform of claim 5, wherein the plurality of second cushion members are disposed adjacent to a long side of the first cushion member, such that a top surface of at least one of the plurality of second cushion members and a top surface of the first cushion member are substantially within a same plane.

7. A bed extension platform system, comprising:

a first plank and a second plank;

a first strap secured to the first plank and the second plank from below, wherein the first strap is disposed between the first plank and the second plank, and wherein the first strap extends along a length of the cross-bar member; and a plurality of first cushion members having one or more varying thicknesses, wherein the plurality of first cushion members are adapted to be disposed adjacent to a long side of a second cushion member, wherein the plurality of first cushion members and the second cushion member are supported by at least the first plank and the second plank, and wherein a top surface of at least one of the plurality of first cushion members and a top surface of the second cushion member are substantially within a same plane.

8. The bed extension platform system of 7, further comprising:

a plurality of second straps, wherein each of the plurality of second straps are adapted to secure each cross-bar to a bed frame.

* * * * *